US007415216B2

(12) United States Patent
Rasch

(10) Patent No.: US 7,415,216 B2
(45) Date of Patent: Aug. 19, 2008

(54) METHODS AND APPARATUS FOR COMPENSATING FOR FUSER ELEMENT WEAR

(75) Inventor: Keneth Ray Rasch, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 127 days.

(21) Appl. No.: 11/612,970

(22) Filed: Dec. 19, 2006

(65) Prior Publication Data

US 2008/0145086 A1 Jun. 19, 2008

(51) Int. Cl.
*G03G 15/20* (2006.01)

(52) U.S. Cl. ..... 399/69

(58) Field of Classification Search ..... 399/67, 399/69, 328, 330; 347/156
See application file for complete search history.

(56) References Cited

U.S. PATENT DOCUMENTS 5,592,277 A * 1/1997 Kusaka et al. ..... 399/328
5,700,994 A 12/1997 Gheer et al.
6,701,102 B2 * 3/2004 Hasegawa et al. ..... 399/69
7,218,875 B2 * 5/2007 Baruch et al. ..... 399/69

* cited by examiner

*Primary Examiner*—Sandra L Brase
(74) *Attorney, Agent, or Firm*—Oliff & Berridge, PLC

(57) ABSTRACT

To compensate for fuser element wear, a fuser element is heated to a first temperature to fuse a first substrate at a first time, at which the fuser element has a first thickness, and is heated to a second temperature to fuse a second substrate at a second time, at which the fuse element has a second thickness smaller than the first thickness due to wear.

20 Claims, 4 Drawing Sheets

METHODS AND APPARATUS FOR COMPENSATING FOR FUSER ELEMENT WEAR

BACKGROUND

Many marking devices, such as printers and photocopier, use dry ink, toner or other marking media that is transferred to a substrate in a known manner, and is subsequently fused to the substrate by heat and/or pressure by a fuser that includes one or more fuser elements.

Fuser elements are typically in the form of a rotating cylinder, with an outer layer comprising a thin elastomeric layer that contacts the substrate. The adhering to the surface of the fuser roll itself. The outer layer is typically formed on an inner base, which is typically a hollow cylinder or core that is fabricated from any suitable metal such as aluminum, anodized aluminum, steel, nickel, copper, or the like. Fuser rolls commonly used have outer layers of a thickness on the order of 0.002 0.07 inches (2 to 70 mils), while typical pressures exerted on the outer layer of a fuser roll are on the order of 50 to 150 psi. A heater, usually a radiant heater, is typically positioned inside the fuser roll, and heats the fuser roll to a desired temperature, typically about 190° C. A second roll, which may also be a fuser roll that is heated like the first fuser roll, or which may be unheated, is typically positioned adjacent the first fuser roll such that a nip is formed between the two rolls. The toner-coated substrate is fed into the nip as the rolls rotate, and the toner is fused to the substrate as it passes through the nip. An example of one such fuser is shown in U.S. Pat. No. 5,700,994, which is incorporated herein by reference in its entirety.

SUMMARY

Over time, the outer layer of the fuser roll reduces in thickness due to the wear caused by substrates passing through the nip. This reduction in thickness changes the heat transfer characteristics within the nip. When the outer layer thickness is reduced, more heat is transferred to the substrate, which can result in curling of the substrate, and/or cause other undesirable effects.

Exemplary embodiments according to this disclosure address such problems by compensating for fuser element wear. For example, a fuser element may be heated to a first temperature to fuse a first substrate at a first time, at which the fuser element has a first thickness, and the fuser element may be heated to second temperature to fuse a second substrate at a second time, at which the fuser element has a second thickness smaller than the first thickness due to wear. The second temperature is preferably lower than the first temperature. An indication of fuser element wear may be obtained, and the fuser element may be heated to a temperature that is dependent on the indication of fuser element wear.

BRIEF DESCRIPTION OF THE DRAWINGS

Exemplary embodiments will be described with reference to the attached drawings, in which like numerals represent like parts, and in which.

DETAILED DESCRIPTION OF EMBODIMENTS

Exemplary embodiments according to this disclosure compensate for fuser element wear by adjusting the temperature of the fuser element based on the wear.

Figure 1:
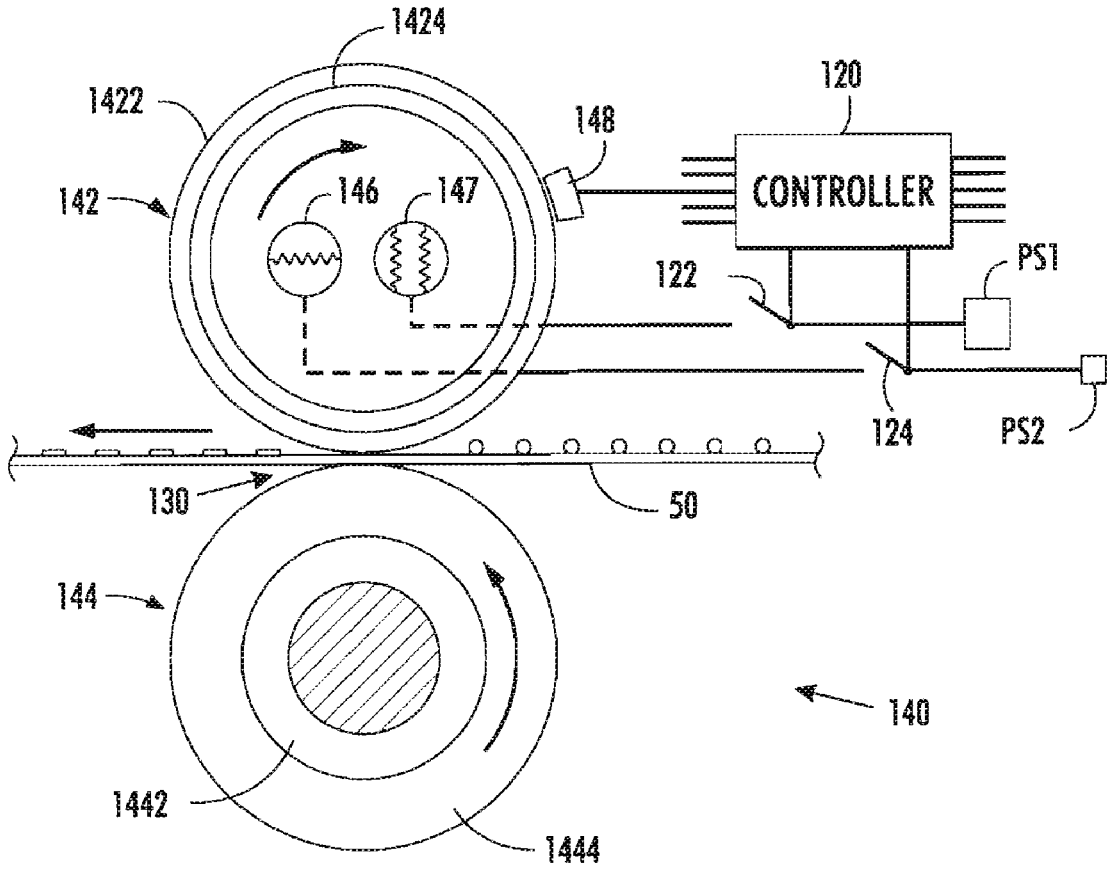
FIG. 1 illustrates a first exemplary fuser.

FIG. 1 illustrates a first exemplary fuser 140. The fuser 140 includes a fuser element in the form of a heated fuser roll 142. The fuser roll 142 as shown has a deformable elastomeric surface 1422 that is formed over a suitable base member 1424. Base member 1424 is preferably a hollow cylinder a core that is fabricated from any suitable metal such as aluminum, anodized aluminum, steel, nickel, copper, or the like. The fuser roll 142 also includes at least a first heater 147, and may also include a second heater 146, as disclosed in detail in U.S. Pat. No. 5,700,994. The heaters 147, 146 may be disposed within a hollow portion of the cylindrical core or base 1424, and may be coextensive with a length of the hollow base member 1424.

The roller type fuser 140 also includes a backup or pressure roll 144 which cooperates with the fuser roll 142 to form a nip or contact arc through which the copy sheet or substrate 50 is passed such that toner images thereon contact the elastomeric surface 1422 of fuser roll 142. As shown in FIG. 1, the backup or pressure roll 144 preferably has a rigid hollow core 1442 and an outer surface layer 1444 comprising, for example, a copolymer perfluoroalky perfluorovinyl ether with tetrafluroethylene (PFA).

The fuser 140 also includes at least a source of main or primary power supply PS1 connected to the first heater 147. PS1 is designed to output a sufficient level of power for maintaining the temperature of the fusing nip 130 at a desired high fusing temperature of around 350° F. The fuser 140 may also include a source of secondary power supply PS2 designed to provide a level of power that is less than that of the primary source PS1, and is equal, for example, to the "power or energy star" power level of 50 watts maximum during low-power or energy-saver mode periods, as discussed in detail in U.S. Pat. No. 5,700,994. Although PS1 and PS2 are shown as two separate power supply sources, they may in fact be merely two levels of power supply from a single source that is controllable by software.

A temperature detector 148 may be provided for sensing the temperature of the fuser roll 142 and providing appropriate input to a controller 120. The controller 120 is connected to the temperature detector 148, and to the sources of power PS1, PS2 via switches 122, 124 respectively. The heater 147 is controllable to heat the fuser roll 142 to different temperatures. The controller 120 controls the heater 147 to heat the fuser roll 142 to a first temperature to fuse a first substrate at a first time, at which the fuser roll 142 has a first thickness, and controls the heater 147 to heat the fuser roll 142 to a second temperature to fuse a second substrate at a second time, at which the fuser roll 142 has a second thickness smaller than the first thickness due to wear. The second temperature is preferably lower than the first temperature.

Figure 2:
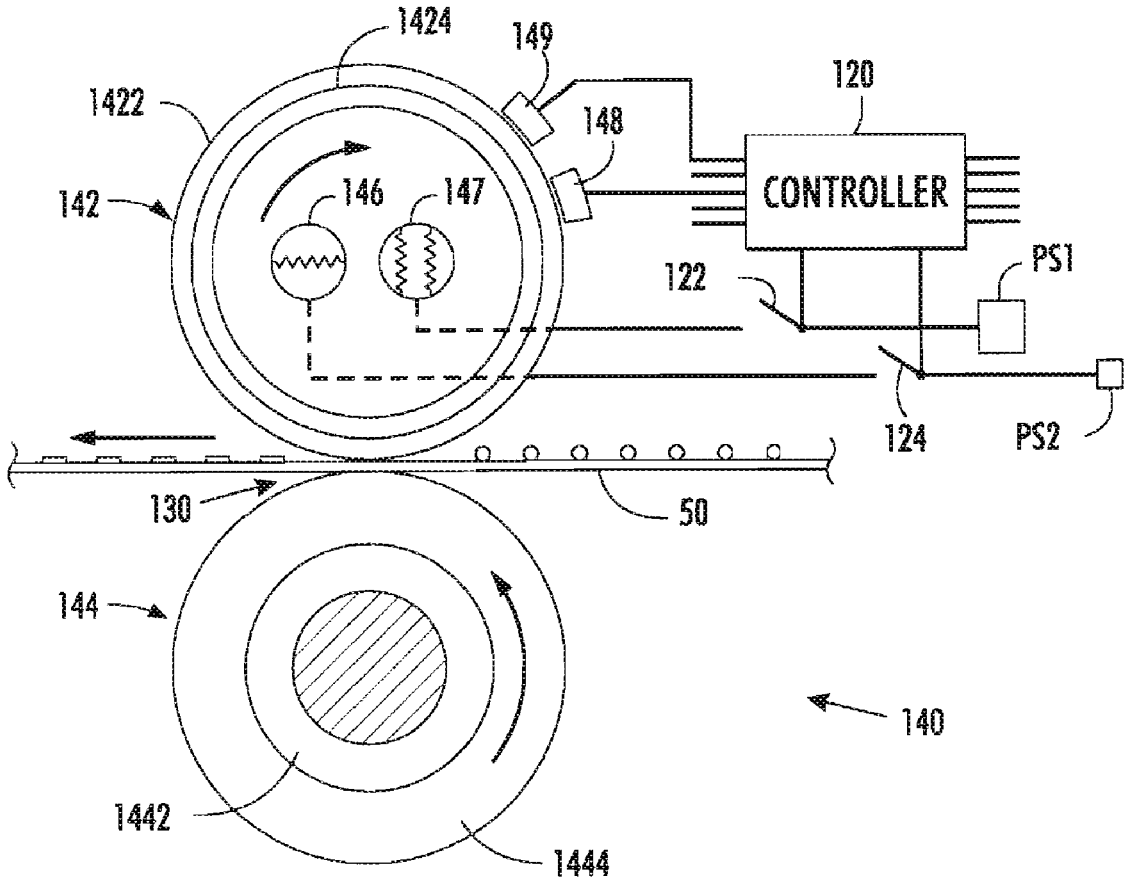
FIG. 2 illustrates a second exemplary fuser.

FIG. 5 illustrates a second exemplary fuser 140. The fuser 140 of FIG. 2 is identical to that of FIG. 1, except that a wear detector 149 is also provided. The wear detector may be any known or later developed wear detector, and may detect wear of the fuser roll 142 by any suitable method, such as a mechanical, acoustic or optical method. The wear detection may be accomplished by measuring thickness of the elastomeric surface 1422, by measuring the diameter of the fuser roll 142, or by taking any other appropriate reading, and then observing the change in the measurement over time. The controller 120 is connected to the wear detector 148 and receives measurement signals from the wear detector 149 and, if necessary, sends signals to the wear detector 149 to control operation of the wear detector 149.

Figure 3:
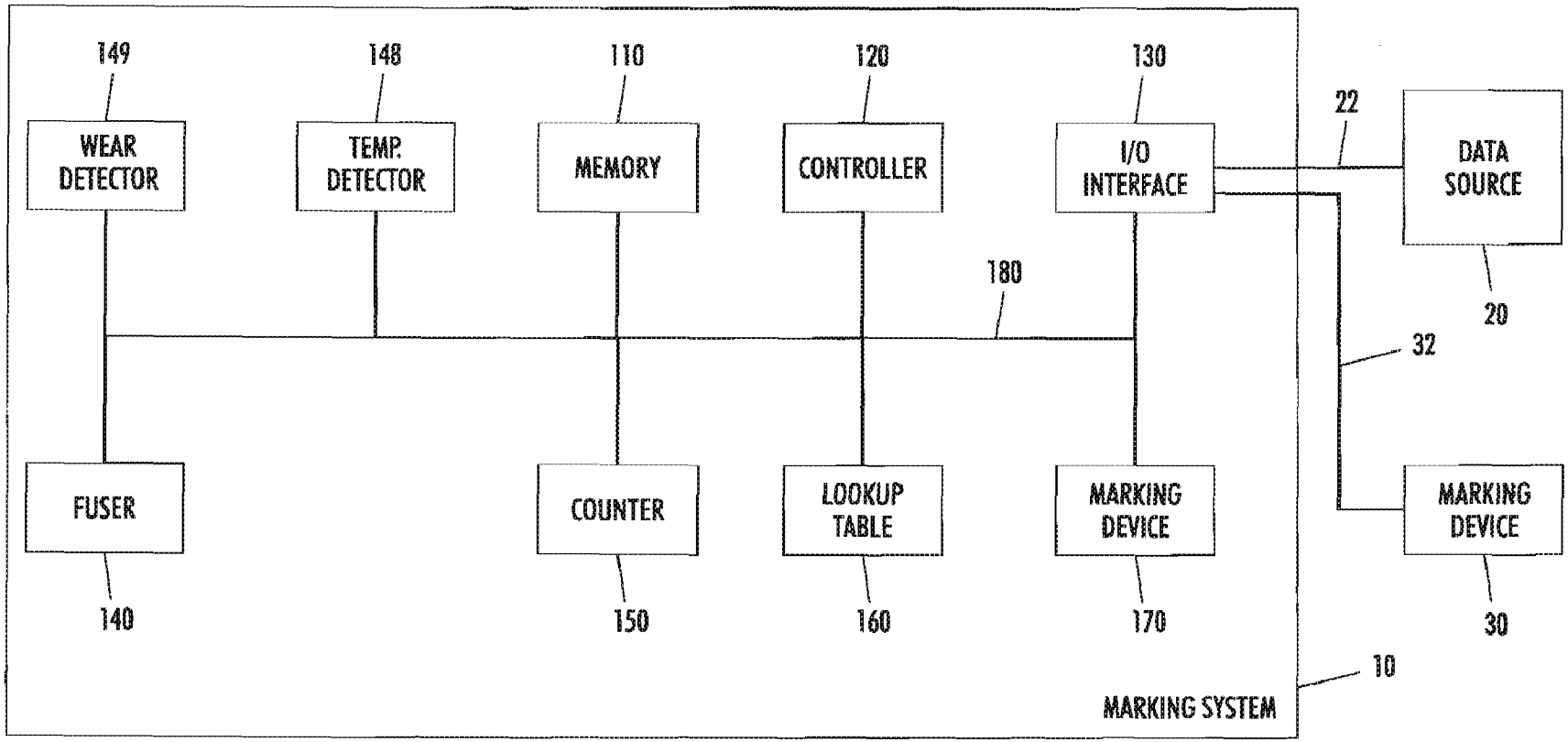
FIG. 3 illustrates an exemplary marking system including the fuser of FIG. 1 or the fuser of FIG. 2.

FIG. 3 illustrates an exemplary marking system 10 including the fuser 140 and controller 120 of FIG. 1 or FIG. 2. The marking system 10 may be connected to a data source 20 via a link 22, and to a user input device 30 via a link 32. The data source 20 can be a digital camera, a scanner, or a locally or remotely located computer, or any other known or later developed device that is capable of generating electronic image or text data. Similarly, the data source 20 can be any suitable device that stores and/or transmits electronic data, such as a client or a server of a network. The data source 20 can be connected to the marking system 10 over a connection device, such as a modem, a local area network, a wide area network, an intranet, the Internet, any other distributed processing network, or any other known or later developed connection device.

It should also be appreciated that, while the electronic data can be generated at the time of printing an image or text from an original physical document, the electronic data could have ben generated at any time in the past. Moreover, the electronic data need not have been generated from the original physical document, but could have been created from scratch electronically. The data source 20 is thus any known or later developed device that is capable of supplying electronic data over the link 22 to the marking system 10.

The user input device 30 may be provided to allow a user to make appropriate inputs to the marking device 10. For example, when the marking system 10 is a printer, the user input device 130 may be a desktop or laptop computer, a wireless Personal Digital Assistant (PDA) or the like at which the user inputs a "print" command. The link 32 can take any of the forms described above for the link 22, for example. When the marking system 10 is a photocopier, the user input device 130 may be a control panel on an upper surface of the photocopier, for example.

The links 22 and 32 can thus be any known or later developed system or device for transmitting the electric data from the data source 20 to the marking system 10. Further, it should be appreciated that the links 22 and 32 can be wired, wireless or optical links to a network (not shown). The network can be a local area network, a wide are network, an intranet, the Internet, or any other distributed processing and storage network.

The marking system 10 includes the controller 120 and the fuser 140 as discussed above, and may also include an input/output interface 130 for communicating with the data source 20 and/or the user input device 30. It will be appreciated that depending on the configuration of the marking system 10, the data source 20 and/or the user input device may be an integral part of the marking system 10, and may be connected directly to the data/control bus 180, rather than being connected via the input/output interface 130. For example, when the marking system 10 is a photocopier, the data source 20 may be a scanner, and the data source 20 and the user input device 30 may be an integral part of the marking system 10, and may be connected directly to the data/control bus 180.

The marking system 10 also includes a memory 110 and a marking device 170, and may further include either or both of a counter 150 and a lookup table 160. The marking system 10 may also include the temperature detector 148 and the wear detector 149.

It will be appreciated that the marking system 10 may omit various ones of the elements depicted in FIG. 3, depending on the particular implementation. For example, when the marking system 10 includes the fuser 140 of FIG. 1, it may not include the wear detector 149, because adjustment of the target temperature of the fuser roll 142, described i more detail below, may not directly depend on actual roll wear. Similarly, when the marking system 10 includes the fuser 140 of FIG. 2, it may not include the counter 150 and/or the lookup table 160 (or may include a different) lookup table, as described below), because adjustment of the target temperature may directly depend on actual, measured roll wear.

The detectors 148 and 149 and the components 110-170 of the marking system 10 are interconnected as appropriate by a data/control bus 180.

In addition to the control described above in connection with the fuser 140, the controller 120 controls the operation of other components of the marking system 10 as necessary, performs any necessary calculations and executes any necessary programs for implementing the processes of the marking system 20 and its individual components, and controls the flow of data between other components of the marking system 10 as needed.

The memory 110 may serve as a buffer for information coming into or going out of the marking system 10, may store any necessary programs and/or data for implementing the functions of the marking system 10, and/or may store data at various stages of processing. Furthermore, it should be appreciated that the memory 110, while depicted as a single entity, may actually be distributed. Alterable portions of the memory 110 are, in various exemplary embodiments, implemented using static or dynamic RAM. However, the memory 110 can also be implemented using a floppy disk and disk drive, a writeable optical disk and disk drive, a hard drive, flash memory or the like. The generally static portions of the memory 110 are, in various exemplary embodiments, implemented using ROM. However, the static portions can also be implemented using other non-volatile memory, such as PROM, EPROM, EEPROM, an optical ROM disk, such as a CD-ROM or DVD-ROM, and disk drive, flash memory or other alterable memory, as indicated above, or the like.

The marking device 170 may be, for example, a marking engine or marking head, such as a print engine or print head, and is capable of reproducing images or text received from the data source 20 by causing marking medium, such as dry ink, toner or the like, to be arranged in appropriate configurations on a substrate.

The counter 150 may be provided to count the cumulative number of fusing events that have been performed by the fuser 140. The counter 150 may be any suitable mechanical, electrical or optical device that performs this function. For example, the counter 150 may include an optical detector that detects resolutions of the fuser roll 142, or detects substrate edges. As one particular example, in embodiments, an optical switch may be used that detects substrate edges and stores total normalized values in a resettable counter that is reset at fuser roll replacement. The values are normalized to account for variations in paper sizes. As another example, the counter 150 may be implemented in software, and increment every item a marking instruction is sent to the marketing device 170.

The lookup table 160 may correlate a target temperature of fuser roll 142 to a cumulative number of fusing events, and may be based on empirical testing of fuser performance at various stages of wear. For example, at 0 fusing events, the target temperature may be 190° C. At 100,000 total fusing events, the target temperature may be 188.9° C. At 200,000 total fusing events, the target temperature may be 187.8° C. Thus, in this example, the temperature decreases by about 1.1° C. per 100,000 fusing events. Alternatively, a formula may be constructed, typically assuming a linear wear characteristic, and also based on empirical testing of fuser performance at various stages of wear. The controller 120 refers to the lookup table 160, or implements the formula, to determine the appropriate target temperature for the fuser roller 142 based on the cumulative number of fusing events. The controller 120 then controls the heater 147 to achieve the target temperature. This gradual reduction in target temperature of the fuser 140 with increase in the cumulative number of fusing events compensates for wear of the fuser roll 142, and promotes uniformity of the heat transfer characteristic of the fuser 140 over time, thereby avoiding or reducing undesired effects such as curling.

The appropriate rate of temperature reduction may be determined empirically for a given fuser roll, coating material, initial coating thickness, substrate type (such as substrate size, thickness and/or material), and/or the like. Depending on such factors, the appropriate range of temperature reduction may, for example, be in a range of from about 0.1° C. to about 5° C. per 100,000 fusing events. The above-described temperature reduction rate of about 1.1° C. per 100,000 fusing events should be appropriate for a marking system in which a fuser roll that is the only heated roll in the fuser has a 63.5 mm diameter aluminum core covered with 0.280 mm of silicon rubber and 0.028 of electrically conductive tetrafluroethylene (PFA), which may have additives to improve wear and/or other properties. A silicon oil with a fluoride chain and having a viscosity of 220 centistokes (CS) may be used as a release agent, and may be applied to the fuser roll by a polyester web in a known manner. A mixture of various substrate types may be used, and the wear characteristic should not be affected very much by the substrate type unless, for example, an unusually high wear-inducing substrate, such as a very thick substrate or the like, is predominantly used. As a particular example, the above-described temperature reduction rate of about 1.1° C. per 100,000 fusing events should be applicable when the substrates used include a mixture of 4024 20# bond (which is typical copy paper) and 65# cover stocks, and coated substrates.

When the marking system 10 includes the fuser 140 of FIG. 2, the above-described temperature control may be replaced with control that is based on actual, measured wear. This control may be accomplished by using a formula or lookup table, which may be construed based on empirical testing, that correlates measured wear to an appropriate target temperature of the fuser roll 142. For example, the lookup table 160 described above may be replaced with a lookup table that correlates appropriate target temperatures of fuser roll 142 to measured wear.

Figure 4:
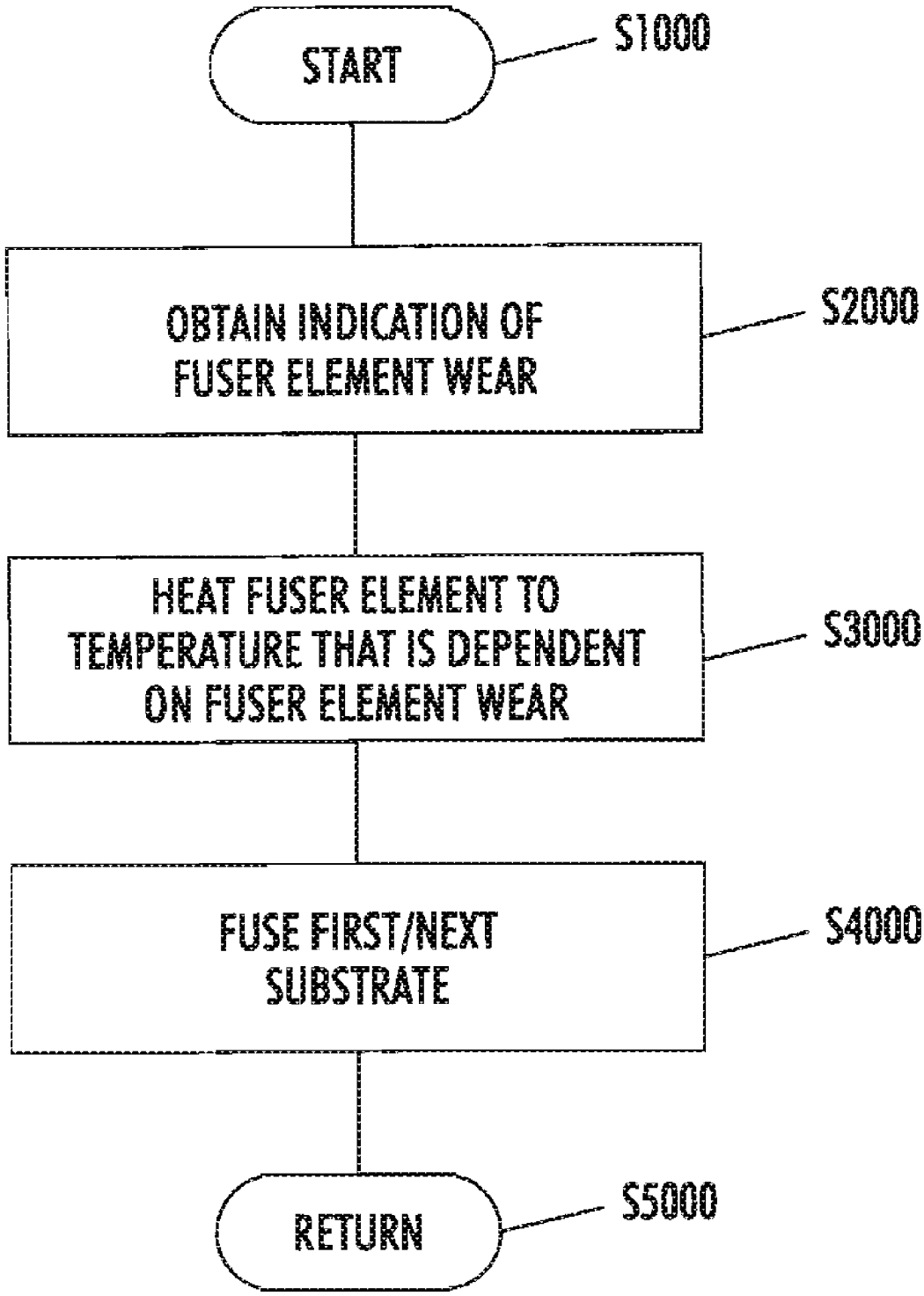
FIG. 4 is a flowchart illustrating an exemplary method for compensating for fuser element wear.

FIG. 4 is a flowchart illustrating an exemplary method for compensating for fuser element wear. Beginning in step S1000, the method proceeds to step S2000, and obtains an indication of fuser element ware. This indication may be based on predicted wear, according to, e.g., a wear prediction method described above, or an actual measured wear, measured as described above. The method continues to step S3000 and heats the fuser element to an appropriate temperate that has been determined based on the fuser element wear. The method continues to step S4000, where the current substrate is fused, then returns at step S5000. The method is repeated for a subsequent substrate.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A method for compensating for fuser element wear, comprising:

heating a fuser element to a first temperature to fuse a first substrate at a first time, at which the fuser element has a first thickness; and heating the fuser element to a second temperature to fuse a second substrate at a second time, at which the fuser element has a second thickness smaller than the first thickness due to wear, the second temperature being lower than the first temperature.

2. The method of claim 1, further comprising applying an algorithm to determine an appropriate temperature for fusing at the second time.

3. The method of claim 2, wherein applying the algorithm comprises accessing a lookup table that correlates temperature to a cumulative number of fusing events.

4. The method of claim 2, wherein the algorithm includes a formula.

5. The method of claim 4, wherein the formula is based on an assumption of a linear wear characteristic of the fuser element.

6. The method of claim 2, wherein applying the algorithm comprises adjusting energy applied to the fuser element such that temperature of the fuser element decreases by about 1.1° C. per 100,000 fusing events.

7. The method of claim 1, further comprising measuring actual wear of the fuser element to determine an appropriate temperature for fusing at the second time.

8. A storage medium on which is recorded a program for causing a marking system to implement the method of claim 1.

9. A fuser element wear compensation system, comprising:

a heater that heats a fuser element, the heater being controllable to heat the fuser element to different temperatures; and a controller that:

controls the heater to heat the fuser element to a first temperature to fuse a first substrate at a first time, at which the fuser element has a first thickness; and controls the heater to heat the fuser element to a second temperature to fuse a second substrate at a second time, at which the fuser element has a second thickness smaller than the first thickness due to wear, the second temperature being lower than the first temperature.

10. The fuser element wear compensation system of claim 9, wherein the controller applies an algorithm to determine an appropriate temperature for fusing at the second time.

11. The fuser element wear compensation system of claim 10, further comprising a lookup table, accessed by the controller, that correlates temperature to a cumulative number of fusing events.

12. The fuser element wear compensation system of claim 10, wherein the algorithm includes a formula.

13. The fuser element wear compensation system of claim 12, wherein the formula is based on an assumption of a liner wear characteristic of the fuser element.

14. The fuser element wear compensation system of claim 10, wherein the controller adjusts energy applied to the fuser element such that temperature of the fuser element decreases by about 1.1° C. per 100,000 fusing events.

15. The fuser element wear compensation system of claim 9, further comprising a wear detector that measures actual wear of the fuser element to determine an appropriate temperature for fusing at the second time.

16. A marking system including the fuser element wear compensation system of claim 9.

17. A xerographic marking system including the fuser element wear compensation system of claim 9.

18. A method for compensating for fuser element wear, comprising:

obtaining an indication of fuser element wear; and heating the fuser element to a temperature that is dependent on the indication of fuser element wear, the temperature being lower as fuser element wear increases.

19. The method of claim 18, wherein obtaining the indication of fuser element wear comprises referring to a counter that counts a cumulative number of fusing events.

20. A storage medium on which is recorded a program for causing a marking system to implement the method of claim 18.

* * * * *